US008591177B2

(12) United States Patent
Yokoyama et al.

(10) Patent No.: US 8,591,177 B2
(45) Date of Patent: Nov. 26, 2013

(54) STRUCTURE OF RADIAL TURBINE SCROLL

(75) Inventors: Takao Yokoyama, Nagasaki (JP); Katsuyuki Osako, Nagasaki (JP); Motoki Ebisu, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 502 days.

(21) Appl. No.: 12/867,272

(22) PCT Filed: Oct. 14, 2009

(86) PCT No.: PCT/JP2009/067798

§ 371 (c)(1),
(2), (4) Date: Aug. 27, 2010

(87) PCT Pub. No.: WO2010/047259

PCT Pub. Date: Apr. 29, 2010

(65) Prior Publication Data

US 2011/0008162 A1 Jan. 13, 2011

(30) Foreign Application Priority Data

Oct. 20, 2008 (JP) ..... 2008-269466

(51) Int. Cl.
*F04D 29/66* (2006.01)

(52) U.S. Cl.
USPC ..... 415/119; 415/205

(58) Field of Classification Search
USPC ..... 415/119, 205, 203, 204, 208.1
See application file for complete search history.

(56) References Cited

U.S. PATENT DOCUMENTS

| | | | | | |
|---|---|---|---|---|---|
| 3,687,360 | A * | 8/1972 | Prew et al. | 494/85 |
| 4,473,931 | A * | 10/1984 | Komatsu | 29/889.2 |
| 4,544,326 | A * | 10/1985 | Nishiguchi et al. | 415/151 |
| 4,678,397 | A * | 7/1987 | Komatsu et al. | 415/151 |
| 4,781,528 | A * | 11/1988 | Hagita et al. | 415/151 |
| 5,601,400 | A * | 2/1997 | Kondo et al. | 415/119 |
| 6,742,989 | B2 * | 6/2004 | Osako et al. | 415/205 |
| 7,269,950 | B2 * | 9/2007 | Pedersen et al. | 60/602 |
| 7,428,814 | B2 * | 9/2008 | Pedersen et al. | 60/602 |
| 2003/0077170 | A1 | 4/2003 | Osako et al. | |
| 2007/0089414 | A1 | 4/2007 | Yokoyama et al. | |

FOREIGN PATENT DOCUMENTS

| | | | |
|---|---|---|---|
| JP | 2002-4871 | A | 1/2002 |
| JP | 2003-120303 | A | 4/2003 |
| JP | 2003-322025 | A | 11/2003 |
| JP | 2004-92481 | A | 3/2004 |
| JP | 2007-113501 | A | 5/2007 |

* cited by examiner

*Primary Examiner* — Edward Look
*Assistant Examiner* — William Grigos
(74) *Attorney, Agent, or Firm* — Birch, Stewart, Kolasch & Birch, LLP

(57) ABSTRACT

In a radial turbine scroll, an operating gas is led to flow in the radial direction from a spiral scroll formed in a turbine casing into turbine moving blades of a turbine rotor, which is positioned on the inner side of the scroll, so as to act on the turbine moving blades, and then led to flow outside in an axial direction, thereby rotatively driving the turbine rotor, wherein the scroll 4 has a partition plate 20 a length of a certain range on a line of a tongue portion formed on the inner periphery of a gas inlet portion or has a reduced height between scroll side walls at an outlet portion of a tongue portion 21 formed on the inner periphery of a gas inlet portion of the scroll.

7 Claims, 8 Drawing Sheets

(A)

(B)

(B)

(A)

(C)

(D)

STRUCTURE OF RADIAL TURBINE SCROLL

BACKGROUND OF THE INVENTION

1. Field of the Invention

The present invention relates to a structure of a radial turbine scroll which is used with an exhaust turbosupercharger of a relatively medium- to small-sized internal combustion engine and which is constructed such that an operating gas from an engine (internal combustion engine) is led to flow in a radial direction from a spiral scroll formed in a turbine casing into turbine moving blades of a turbine rotor, which is positioned on the inner side of the scroll, to act on the turbine moving blades, and then led to flow out in an axial direction, thereby rotatively driving the turbine rotor.

2. Description of the Related Art

FIG. 6 is a sectional view taken along the line of axial center, illustrating a structure of an engine exhaust turbosupercharger.

In FIG. 6, reference numeral 1 denotes a turbine casing. A spiral scroll 4 is formed in the turbine casing 1, and a gas outlet passage 5 is formed at the inner periphery of the turbine casing 1.

A bearing housing 9 is fixed to the turbine casing 1, and a compressor housing 6 is fixed to the bearing housing 9.

A turbine rotor is denoted by reference numeral 10. A plurality of turbine moving blades 3 is secured to an outer periphery of the turbine rotor 10 at regular intervals in the circumferential direction.

The compressor housing 6 accommodates a compressor 7, and a diffuser 8 is provided at an air outlet of the compressor 7. A rotor shaft 12 connecting the turbine rotor 10 and the compressor 7 is supported by the bearing housing 9 through the intermediary of two bearings 11 and 11. The center of rotation is denoted by 20Z.

FIGS. 7(A), (B), and (C) are sectional diagrams of the scroll 4 of the turbine casing 1 and a W-W sectional diagram (FIG. 7(C)) thereof.

In the exhaust turbosupercharger, an exhaust gas from an engine enters the scroll 4, circumferentially moves along the convolution of the scroll 4 to flow into the turbine moving blades 3 from an end surface of an inlet 4*c* on the outer peripheral side of the turbine moving blades 3, further flows in the radial direction toward the center of the turbine rotor 10 to carry out expansion work on the turbine rotor 10, and then flows out in the axial direction to be discharged outside through the gas outlet passage 5.

At the time of the aforesaid operation, as illustrated in FIGS. 7(A), (B), and (C), the scroll 4 is formed in a spiral shape in the turbine casing 1, and a tongue portion 21 is formed on the inner periphery of a gas inlet portion of the scroll 4. The tongue portion 21 needs to have a thickness of approximately at least 3 mm, because the turbine casing 1 is a casting.

Hence, a wake (low-speed area) 30 at the tongue portion occurs when the exhaust gas flows. The wake 30 is larger in FIG. 7(B) wherein the tongue portion 21 is thicker than in that in the case of FIG. 7(A), so that the deterioration of the performance of the turbine caused by the wake 30 at the tongue portion 21 is worse accordingly.

The one disclosed in Patent Document 1 (Japanese Patent Application Laid-Open No. 2003-120303) has a tongue portion formed on the inner periphery of a gas inlet portion of a scroll. The sectional area of a flow passage adjacent to a flow immediately below the tongue portion is set to be smaller than the sectional area of a flow passage at a tongue portion end by the dimension equivalent to the thickness of the tongue portion in the width direction, thus permitting a reduction in the wake occurring at the tongue portion.

As described above, in the conventional exhaust turbosupercharger, as illustrated in FIGS. 7(A), (B) and (C), the wake (low-speed area) 30 at the tongue portion occurs at the time of the flow of an exhaust gas, and the wake 30 increases as the tongue portion 21 is thicker. The occurrence of the wake 30 at the tongue portion 21 leads to the deterioration of the turbine performance.

More specifically, the wake (low-speed area) 30 is attributable to the flow of a gas moving from a radially outer side toward a radially inner side, and the flow of the exhaust gas heading toward the inner side is smaller in the case where the tongue portion 21 is thinner, as illustrated in FIG. 7(A), resulting in less deterioration of the turbine performance. In this case, however, the thermal stress increases since the tongue portion 21 is thinner.

[Patent Document 1] Japanese Patent Application Laid-Open No. 2003-120303

SUMMARY OF THE INVENTION

In view of the problem with the prior art, an object of the present invention is to provide a structure of a radial turbine scroll which restrains the degradation of turbine performance by avoiding a gas flow heading from a radially outer side to a radially inner side in the vicinity of a tongue portion and which reduces thermal stress attributable to the formation of the tongue portion to a maximum.

To this end, the present invention provides a structure of a radial turbine scroll in which an operating gas is led to flow from a spiral scroll formed in a turbine casing into turbine moving blades of a turbine rotor, which is positioned on an inner side of the scroll, in a radial direction to act on the turbine moving blades, and then led to flow out in an axial direction, thereby rotatively driving the turbine rotor, wherein the scroll has a partition plate formed to have a length of a certain range on a line of a tongue portion formed on the inner periphery of a gas inlet portion or has a reduced height between scroll side walls at an outlet portion of the tongue portion formed on the inner periphery of the gas inlet portion of the scroll, thereby avoiding a gas flow from the radially outer side to the radially inner side in the vicinity of the tongue portion.

In particular, according to the present invention, the scroll has the partition plate formed to have a length of a certain range on the line of the tongue portion formed on the inner periphery of the gas inlet portion so as to restrain a gas in an upper space of the partition plate from flowing into a lower space thereof by the partition plate.

In the invention, the partition plate is preferably protrusively provided on a turbine casing wall surface continuing to a shroud side of the turbine moving blades of the scroll.

Further, in the invention, preferably, the section of an end portion of the partition plate is shaped to have an inclined surface trending toward the upper space, the inclined surface being obtained by cutting the end portion from the upper space side toward the lower space side.

Further, according to the present invention:

(1) the flow passage area of the lower space of the partition plate is reduced in the circumferential direction to induce a narrowing effect, thereby generating a gas flow from the lower space to the upper space of the partition plate; and (2) the flow passage area of the lower space of the partition plate is reduced in the circumferential direction rather than reducing the flow passage area of the upper space of the partition plate, thereby restraining the gas flow from the upper space to the lower space.

Further, according to the present invention, in the structure of the radial turbine scroll, a partition member having a length of a certain range on the line of the tongue portion formed on the inner periphery of the gas inlet portion of the scroll is disposed, and in the partition member, a passage area changes in the circumferential direction such that the passage area of an end portion is large, while the passage area decreases toward the tongue portion along a circumferential direction.

Further, according to the present invention, in the structure of a radial turbine scroll in which an operating gas is led to flow from a spiral scroll formed in a turbine casing into turbine moving blades of a turbine rotor, which is positioned on the inner side the scroll, in a radial direction to act on the turbine moving blades, and then led to flow out in an axial direction, thereby rotatively driving the turbine rotor, the height between the scroll side walls at an outlet portion of the tongue portion formed on the inner periphery of the gas inlet portion of the scroll is reduced to narrow the passage sectional area at the outlet portion of the tongue portion.

According to the present invention, in the structure of a radial turbine scroll, the scroll has the partition plate formed to have a length of a certain range on the line of the tongue portion formed on the inner periphery of the gas inlet portion so as to restrain a gas in the upper space of the partition plate from flowing into the lower space thereof by the partition plate. Further, in the invention, protrusively providing the partition plate on a turbine casing wall surface continuing to the shroud side of the scroll turbine moving blades makes it possible to restrain an exhaust gas flow from moving from the upper space of the scroll toward the lower space thereof by the partition plate by protrusively providing the partition plate, which has the length of a certain range on the line of the tongue portion, particularly on a turbine casing wall surface continuing to the shroud side of the turbine moving blades.

Thus, the exhaust gas flow from the upper space to the lower space is reduced, allowing the occurrence of a wake to be restrained. This makes it possible to prevent turbine efficiency from deteriorating.

Moreover, since an opening can be formed in the partition plate, the thermal restriction due to the formed partition plate and tongue portion is reduced, thus allowing the thermal stress caused by the restriction to be reduced.

Further, in the present invention, with the section of an end portion of the partition plate shaped to have an inclined surface trending toward the upper space by cutting the end portion from the upper space side to the lower space side, although a gas flow heading to the radially inner side causes a wake to occur from the partition plate, the end portion of the partition plate, which has been shaped to have the inclined surface trending toward the upper space side, reduces a projected area of the end portion of the partition plate relative to the direction of the gas flow, thus leading to a reduced wake.

Further, according to the present invention, the flow passage area of the lower space of the partition plate is reduced in the circumferential direction to induce a narrowing effect, thereby generating a gas flow from the lower space to the upper space of the partition plate; therefore, producing the narrowing effect by reducing the flow passage area of the lower space of the partition plate in the circumferential direction generates a force that causes an exhaust gas to flow from the lower space of the partition plate to the upper space, thus making it possible to restrain the inflow heading from the upper space side to the lower space side of the tongue portion.

Further, in the present invention, restraining a gas flow from the upper space to the lower space by reducing the flow passage area of the lower space of the partition plate in the circumferential direction without reducing the flow passage area of the upper space of the partition plate makes it possible to restrain the inflow from the upper space side to the lower space side of the tongue portion, since the flow passage area of the upper space of the partition plate is not reduced.

Further, in the present invention, a partition member having a length of a certain range on the line of the tongue portion formed on the inner periphery of the gas inlet portion of the scroll is disposed, and in the partition member, a passage area changes in the circumferential direction such that the passage area of an end portion thereof increases along a circumferential direction, while the passage area decreases toward the tongue portion; therefore, the inflow of an exhaust gas can be restrained by widening the end portion opposite from the tongue portion which receives a small inflow of the exhaust gas, while decreasing the area of a passage in the vicinity of the tongue portion which receives a largest inflow of the exhaust gas. Further, the projected area of the passage can be reduced, as described above, thus allowing the wake at the tongue portion to be reduced.

The partition member is formed such that, along the circumferential direction, the passage area of an end portion is large and the passage area is gradually decreased, the passage area being the smallest in the vicinity of the tongue portion.

Further, according to the present invention, the height between the scroll side walls at the outlet portion of the tongue portion formed on the inner periphery of the gas inlet portion of the scroll is reduced to decrease the sectional area of the passage at the outlet portion of the tongue portion; therefore, by reducing the height of the scroll in the axial direction at the outlet portion of the tongue portion, that is, by decreasing the sectional area of the passage at the outlet portion of the tongue portion, it is possible to prevent a rapid increase in the passage area caused by the absence of the tongue portion, and a smooth reduction in the area allows the disturbance of a flow after the tongue portion to be reduced, thus permitting a reduced wake at an inner scroll of the tongue portion.

BRIEF DESCRIPTION OF THE DRAWINGS

FIG. 1(A) is a view observed at right angle to the axis of a turbine casing; and FIG. 1(B) is a sectional diagram taken at line A-A in FIG. 1(A).

DETAILED DESCRIPTION OF THE INVENTION

Figure 1:
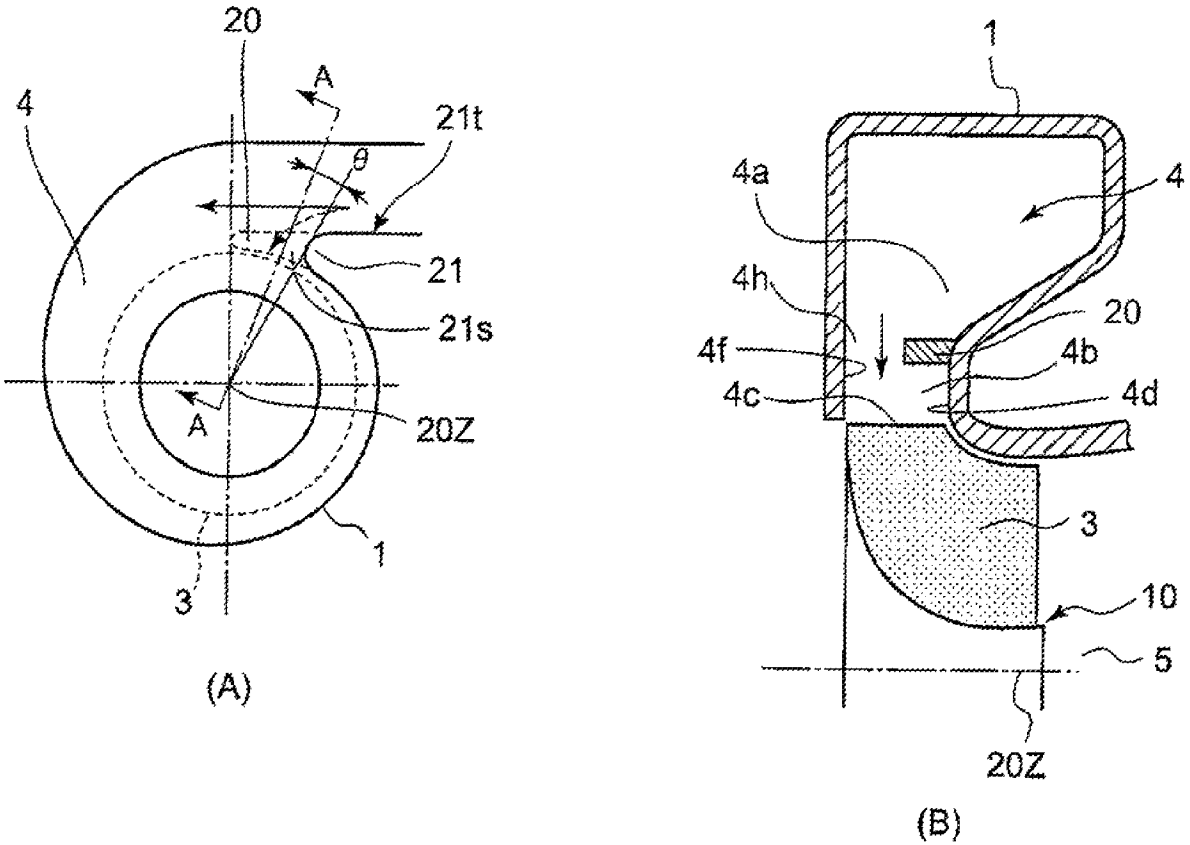
FIG. 1 illustrates a structure of a radial turbine scroll of an exhaust turbosupercharger according to a first embodiment of the present invention.

The following will explain the present invention in detail by using embodiments illustrated in the drawings. It should be noted that the dimensions, the materials, the shapes, the relative placements and the like of constituent parts described in the embodiments are not intended to limit the range of the invention thereto, but they are merely explanatory examples unless otherwise specified.

Figure 6:
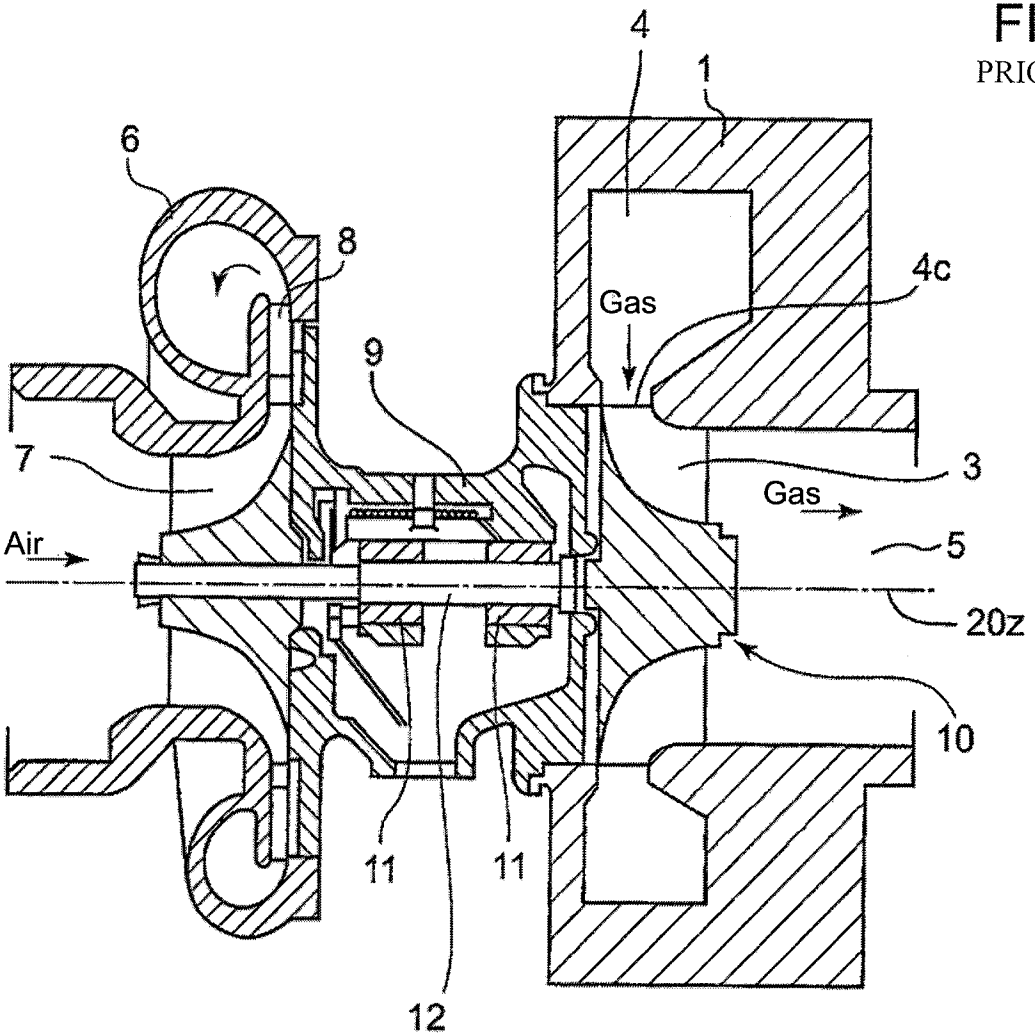
FIG. 6 PRIOR ART
FIG. 6 is a sectional view along the line of an axial center illustrating the structure of an exhaust turbosupercharger for an engine to which the present invention is applied.

FIG. 6 is a sectional diagram along the line of axial center illustrating the structure of an exhaust turbosupercharger for an engine to which the present invention is applied.

In FIG. 6, reference numeral 1 denotes a turbine casing, and a spiral scroll 4 is formed in the turbine casing 1. Further, a gas outlet passage 5 is formed in the inner periphery of the turbine casing 1.

A bearing housing 9 is fixed to the turbine casing 1, and a compressor housing 6 is fixed to the bearing housing 9.

A turbine rotor is denoted by reference numeral 10, and a plurality of turbine moving blades 3 is secured to the outer periphery of the turbine rotor 10 at regular intervals in the circumferential direction.

The compressor housing 6 accommodates a compressor 7, a diffuser 8 being provided at an air outlet of the compressor 7. A rotor shaft 12 connecting the turbine rotor 10 and the compressor 7 is supported by a bearing housing 9 through the intermediary of two bearings 11 and 11. The center of rotation is denoted by 20Z.

In the exhaust turbosupercharger, an exhaust gas from an engine enters the scroll 4, circumferentially moves along the convolution of the scroll 4 to flow into the turbine moving blades 3 from an end surface of an outer peripheral inlet 4*c* of the turbine moving blades 3, flows in the radial direction toward the center of the turbine rotor 10 to carry out an expansion work on the turbine rotor 10, and then flows out in the axial direction to be discharged outside through a gas outlet passage 5.

At the time of the above operation, the wake (low-speed area) at the tongue portion occurs when the exhaust gas flows, causing the turbine performance to deteriorated, as described above.

The present invention restrains the occurrence of a wake thereby to prevent the deterioration of turbine efficiency caused by the occurrence of the wake.

FIRST EMBODIMENT

FIG. 1 illustrates the structure of a radial turbine scroll of an exhaust turbosupercharger according to a first embodiment of the present invention. FIG. 1(A) is a view observed at right angle to the axis of a turbine casing, and FIG. 1(B) is a sectional diagram taken at line A-A in FIG. 1(A).

An exhaust gas from an engine enters a scroll 4 of a turbine casing 1, circularly moves along the convolution of the scroll 4 to flow into turbine moving blades 3 from an end surface of an outer peripheral inlet 4*c* of the turbine moving blades 3, flows in the radial direction toward the center of the turbine rotor 10 to carry out an expansion work on the turbine rotor 10, and then flows out in the axial direction to be discharged outside through the gas outlet passage 5. The axial center of rotation is denoted by 20Z.

In the first embodiment of the present invention, the scroll 4 is provided with a partition plate 20 formed to have a length of a certain range on a line of a tongue portion 21 formed on the inner periphery of an opening 21*s*.

More specifically, as illustrated in FIG. 1(A), the partition plate 20 is located at a position in the circumferential direction such that an angle θ on a side away from the tongue portion 21 is appropriately at least 10 degrees or more from the line 21*t* that connects an end portion of the tongue portion 21 and the center of rotation 20Z on a line of the tongue portion 21, i.e., on the line 21*t* extended from the center of the tongue portion 21.

As illustrated in FIG. 1(A), the opening 21*s* is formed between the partition plate 20 and the tongue portion 21.

Further, as illustrated in FIG. 1(B), the partition plate 20 is made of a plate material and protrusively provided on a wall surface of the turbine casing 1 on a shroud side 4*d* of the turbine moving blades 3 of the scroll 4.

Providing the partition plate 20 divides the scroll 4 into a scroll outer side 4*a*, which is located on the outer side of the partition plate 20, and a scroll inner side 4*b*, which is located on the inner side of the partition plate 20. Further, a portion where the partition plate 20 is absent provides an opening 4*h*.

With this arrangement, the partition plate 20 restrains the flow of a gas into the scroll outer side 4*a* of an upper space of the partition plate 20 and the scroll inner side 4*b* of a lower space.

The partition plate 20 may be protrusively provided on the wall surface of the turbine casing 1 on a hub side 4*f* of the turbine moving blades 3 of the scroll 4.

Figure 7:
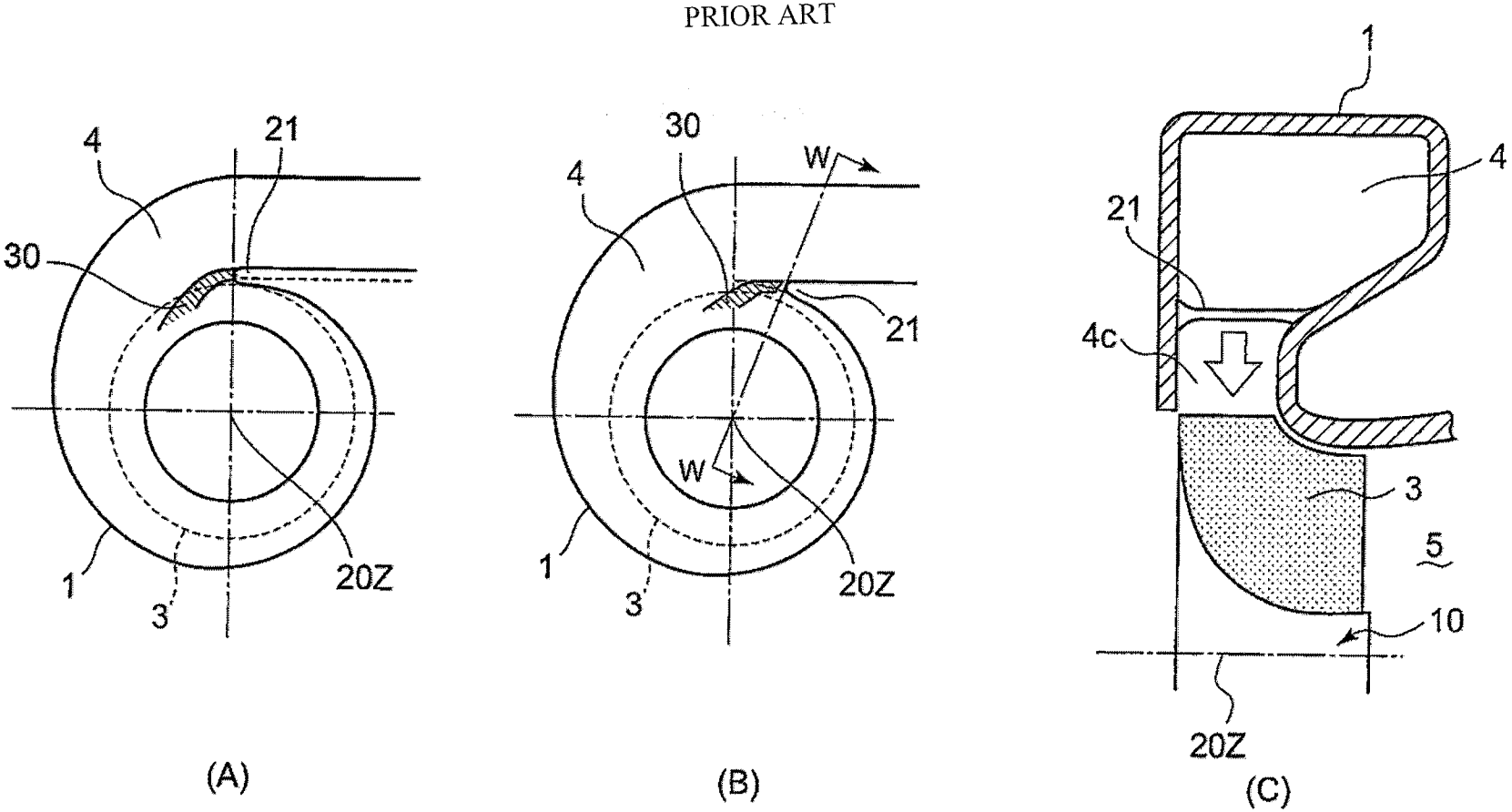
FIG. 7 PRIOR ART
FIGS. 7(A), 7(B) and 7(C) related to a prior art are sectional diagrams of a scroll of a turbine casing.

According to the first embodiment described above, the partition plate 20 extending to a length of a certain range on the line of the tongue portion 21 has been protrusively provided particularly on the turbine casing wall surface continuing to the shroud side 4*d* of the turbine moving blades 3, thus making it possible to restrain an exhaust gas flow heading from the scroll outer side (the upper space) 4*a* of the scroll 4 toward the scroll inner side (the lower space) 4*b* thereof by the partition plate 20. This makes it possible to restrain the occurrence of a wake 30 (refer to FIG. 7).

Hence, the exhaust gas flow moving from the scroll outer side (the upper space) 4*a* toward the scroll inner side (the lower space) 4*b* can be reduced and the occurrence of the wake 30 can be restrained, thus preventing the turbine efficiency from deteriorating, as described.

In addition, the opening 21*s* can be formed in the partition plate 20, so that the thermal restriction caused by the formation of the partition plate 20 and the tongue portion 21 is reduced, thus permitting a reduction in the thermal stress caused by the restriction.

SECOND AND THIRD EMBODIMENTS

Figure 2:
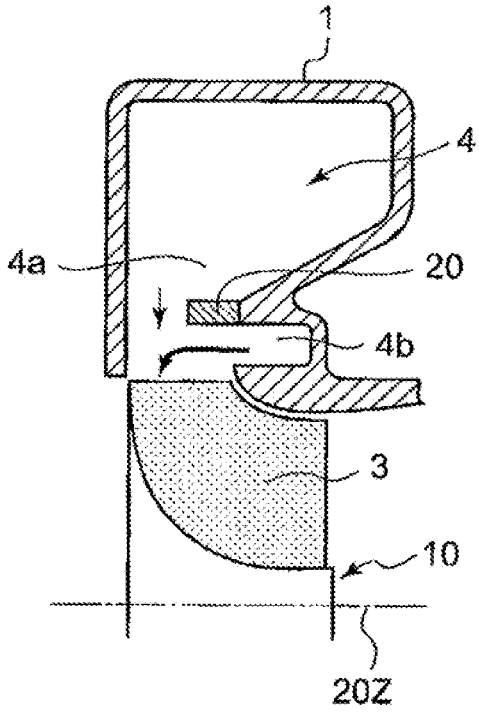
FIG. 2 is a view which illustrates the structure of a radial turbine scroll of an exhaust turbosupercharger according to a second and a third embodiments of the present invention and which is observed at right angle to the axis of a turbine casing.

FIG. 2 is a view at right angle to the axis of a turbine casing, illustrating the structure of a radial turbine scroll of an exhaust turbosupercharger according to a second and a third embodiments of the present invention.

In the second embodiment of the present invention, the flow passage area of a scroll inner side (a lower space) 4*b* of the aforesaid partition plate 20 is reduced in the circumferential direction so as to induce a narrowing effect, thereby generating a gas flow from the scroll inner side (the lower space) 4*b* to a scroll outer side (an upper space) 4*a* of the partition plate 20.

With this arrangement, inducing the narrowing effect by reducing the flow passage area of the scroll inner side (the lower space) 4*b* of the partition plate 20 in the circumferential direction generates a force that causes an exhaust gas to flow from the scroll inner side (the lower space) 4*b* of the partition plate 20 to the scroll outer side (the upper space) 4*a*, thus making it possible to restrain the inflow heading from the scroll outer side (the upper space) 4*a* to the scroll inner side (the lower space) 4*b* of the tongue portion 21.

Further, in the third embodiment of the present invention, a gas flow from the scroll outer side (the upper space) 4*a* to the scroll inner side (the lower space) 4*b* is restrained by reducing the flow passage area of the scroll inner side (the lower space) 4*b* of the partition plate 20 in the circumferential direction without reducing the flow passage area of the scroll outer side (the upper space) 4*a* of the partition plate 20.

With this arrangement, the flow passage area of the scroll outer side (the upper space) 4*a* of the partition plate 20 is not reduced, thus making it possible to restrain the inflow heading from the scroll outer side (the upper space) 4*a* to the scroll inner side (the lower space) 4*b* of the tongue portion 21.

In the second and the third embodiments, the remaining construction is the same as that of the first embodiment described above, and the same members are denoted by the same reference numerals.

FOURTH EMBODIMENT

Figure 3:
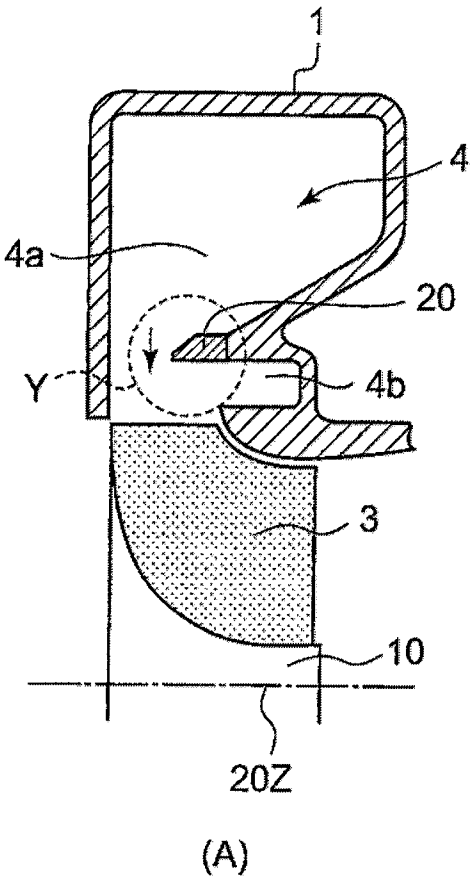
FIG. 3(A) is a view which illustrates the structure of a radial turbine scroll of an exhaust turbosupercharger according to a fourth embodiment of the present invention and which is observed at right angle to the axis of a turbine casing.
FIG. 3(B) is an enlarged view of a portion Y in FIG. 3(A).
Figure 3:
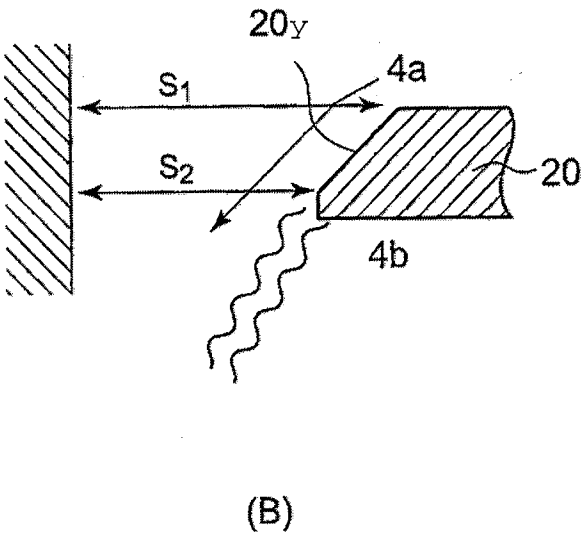

FIG. 3(A) is a view at right angle to the axis of a turbine casing, illustrating the structure of a radial turbine scroll of an exhaust turbosupercharger according to a fourth embodiment of the present invention, and FIG. 3(B) is an enlarged view of a portion Y in FIG. 3(A).

In the fourth embodiment of the present invention, the section of an end portion of a partition plate 20 is shaped to have an inclined surface 20*y* trending toward the scroll outer side (the upper space) 4*a*, the section being obtained by cutting the end portion from the scroll outer side (the upper space) 4*a* to the scroll inner side (the lower space) 4*b*. More specifically, as illustrated in FIG. 3(B), a width S is linearly changed such that the scroll outer side (the upper space) 4*a* has a width S1 and the scroll inner side (the lower space) 4*b* has a width S2.

With this arrangement, although a gas flow heading inward in the radial direction (from the scroll outer side (the upper space) 4*a* to the scroll inner side (the lower space) 4*b*) causes a wake to occur from the partition plate 20, the end portion of the partition plate 20, which has been shaped to have the inclined surface 20*y* trending toward the scroll outer side (the upper space) 4*a*, reduces a projected area of the end portion of the partition plate 20 relative to the direction of the gas flow, thus leading to a reduced wake.

In the fourth embodiment, the remaining construction is the same as that of the first embodiment described above, and the same members are denoted by the same reference numerals.

FIFTH EMBODIMENT

Figure 4:
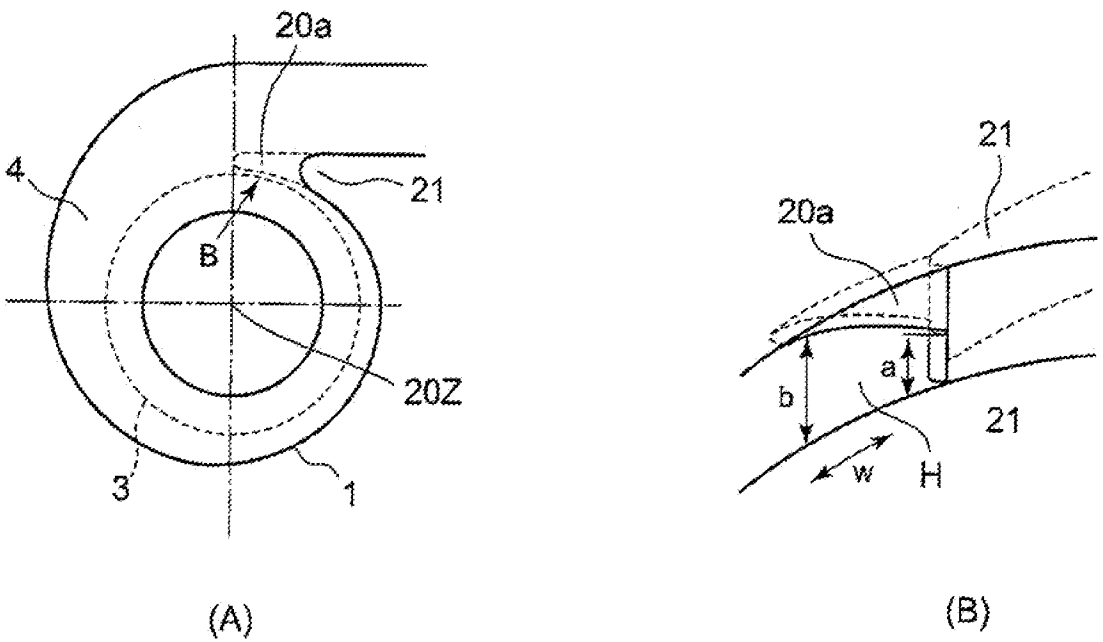
FIG. 4(A) is a view which illustrates the structure of a radial turbine scroll of an exhaust turbosupercharger according to a fifth embodiment of the present invention and which is observed at right angle to the axis of a turbine casing.
FIG. 4(B) is an enlarged fragmentary view indicated by arrow B in FIG. 4(A).

FIG. 4(A) is a view at right angle to the axis of a turbine casing, illustrating the structure of a radial turbine scroll of an exhaust turbosupercharger according to a fifth embodiment of the present invention, and FIG. 4(B) is an enlarged view indicated by an arrow B in FIG. 4(A).

In the fifth embodiment of the present invention, a partition member 20*a* is disposed to extend to a length of a certain range on a line of a tongue portion 21 formed on the inner periphery of a gas inlet portion of a scroll 4. The partition member 20*a* is formed such that the passage width of an opening H (FIG. 4(B)), which provides communication between an upper space on the outer side in the radial direction and a lower space on the inner side in the radial direction, changes in the circumferential direction such that the passage width is larger at an end portion and becomes smaller toward the tongue portion along the circumferential direction. More specifically, as illustrated in FIG. 4(B), passage widths a and b change in a circumferential direction W such that the passage width b is wide at the end portion while the passage width a becomes narrower toward the tongue portion 21 along a circumferential direction W.

With this arrangement, the inflow of an exhaust gas can be restrained by widening the end portion opposite from the tongue portion 21 (the passage width b) to which less exhaust gas flows in and by narrowing the passage width a in the vicinity of the tongue portion 21 to which the most exhaust gas flows in. Further, the projected area of the passage can be reduced, as described above, thus allowing the wake at the tongue portion 21 to be reduced.

The partition member 20*a* is formed so as to continuously change the passage width such that the passage width b of the end portion is large and the passage width gradually narrows along the circumferential direction W and the passage width a becomes the narrowest in the vicinity of the tongue portion 21.

In the fifth embodiment, the remaining construction is the same as that of the first embodiment described above, and the same members are denoted by the same reference numerals.

SIXTH EMBODIMENT

Figure 5:
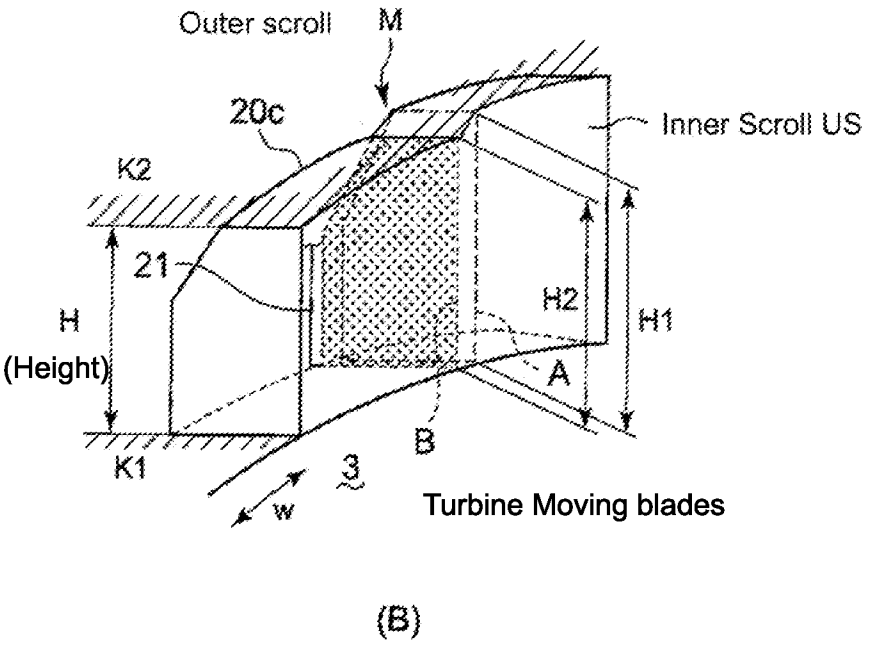
FIG. 5(A) is a view which illustrates the structure of a radial turbine scroll of an exhaust turbosupercharger according to a sixth embodiment of the present invention and which is observed at right angle to the axis of a turbine casing.
FIG. 5(B) is an enlarged view of a portion Z in FIG. 5(A) related to the sixth embodiment of the present invention.
FIG. 5(C) is an explanatory diagram for explaining a change in the height of an inner scroll at an outlet portion of a tongue portion according to the sixth embodiment of the present invention.
FIG. 5(D) is an explanatory diagram for explaining a change in a passage area at the outlet portion of the tongue portion according to the sixth embodiment of the present invention.
Figure 5:
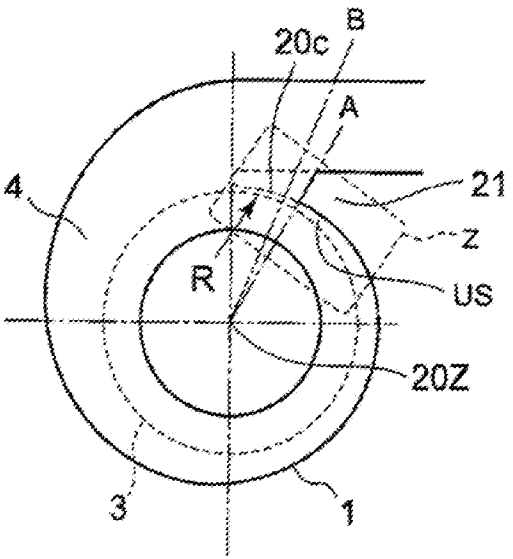
Figure 5:
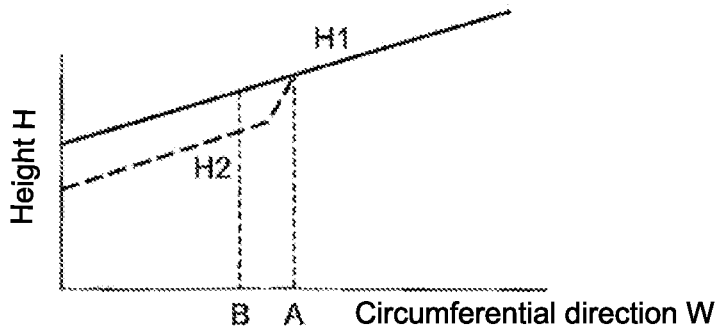
Figure 5:
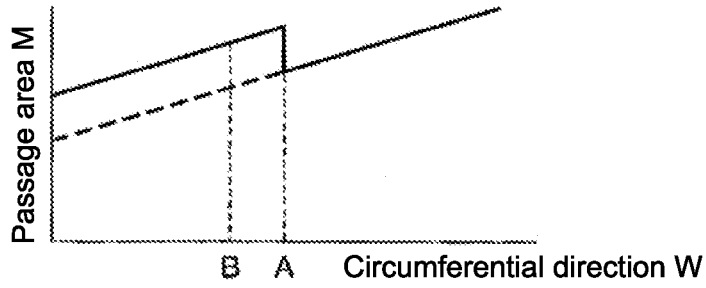

FIG. 5(A) is a view at right angle to the axis of a turbine casing, illustrating the structure of a radial turbine scroll of an exhaust turbosupercharger according to a sixth embodiment of the present invention, and FIG. 5(B) is an enlarged view of a portion Z in FIG. 5(A) and also a perspective view observed from the direction of an arrow R.

In the sixth embodiment of the present invention, a height (H) from one wall K1 to the other wall K2 of a distal portion 20C of a tongue portion 21 is reduced to form a narrowed portion M, as illustrated in FIG. 5(B), rather than providing the partition plate 20 or the partition member 20*a* extending to a middle from one wall toward the other wall of the scroll, as in the first embodiment to the fifth embodiment described above.

More specifically, an inner scroll US positioned on the inner side of the tongue portion 21 and the distal portion 20C existing at the distal end side of the tongue portion of the inner scroll US are narrowed from an upstream side surface A to an outlet surface B at an outlet portion of the tongue portion 21, as illustrated in FIG. 5(B).

In other words, if the height of the inner scroll US at a surface A on the upstream side is denoted as H1 and the height of an outlet surface B is denoted by H2, then the relationship therebetween is expressed by H2<H1.

FIG. 5(C) illustrates the length of the inner scroll US in the axial direction, that is, the relationship of a height H in the circumferential direction in FIG. 5(B). The height of a conventional inner scroll US decreases at a given rate, as indicated by the solid line in FIG. 5(C), while the height in the case of the sixth embodiment is rapidly decreased at the outlet portion of the tongue portion 21, as indicated by the dashed line in FIG. 5(C).

Conventionally, before and after the outlet portion of the tongue portion 21, the area suddenly increases because of the absence of the tongue portion 21, as indicated by the solid line in FIG. 5(D). The aforesaid arrangement makes it possible to prevent the area from suddenly changing, as indicated by the dashed line in FIG. 5(D), by reducing the height of the inner scroll US, as in the sixth embodiment.

With this arrangement, quickly reducing the upstream side surface A of the inner scroll US at the outlet surface B to connect to the distal end portion of the tongue portion 21 makes it possible to prevent a sudden increase in the area of the inner scroll US due to the absence of the tongue portion 21, thereby achieving a scroll with the smoothly reducing area. Thus, the disturbance of the flow after the tongue portion 21 can be reduced, allowing a wake at the inner scroll of the tongue portion to be reduced.

INDUSTRIAL APPLICABILITY

The present invention makes it possible to provide a radial turbine scroll structure which restrains turbine performance from deteriorating by avoiding a gas flow heading from an outer side to an inner side in the radial direction in the vicinity of a tongue portion and which reduces, to a maximum, thermal stress caused by the formation of the tongue portion.

The invention claimed is:

1. A structure of a radial turbine scroll in which an operating gas flows from a spiral scroll formed in a turbine casing into turbine moving blades of a turbine rotor, which is positioned on the inner side of the scroll, in a radial direction to act on the turbine moving blades, and then flows out in an axial direction, thereby rotatively driving the turbine rotor, wherein the scroll has a tongue portion formed on an inner periphery of a gas inlet portion and a partition plate formed on an extended center line of the tongue portion in a circumferential direction, further at some part of a passage width in the width direction, an opening is formed to provide vertical communication between an upper space on an outer side and a lower space on an inner side in the radial direction of the scroll through a part without the partition plate, wherein the passage width of said opening is changed in a circumferential direction of said partition plate or in a cross-section direction from said upper space to the lower space of the partition plate, and wherein the passage width of said opening becomes smaller toward the tongue portion along the circumferential direction.

2. The structure of a radial turbine scroll according to claim 1, wherein a section of an end portion of the partition plate has a shape that is cut from the upper space side to the lower space side such that an opening width relative to an inner wall surface of the scroll decreases toward radial inner side.

3. The structure of a radial turbine scroll according to claim 2, wherein the end portion of the partition plate is shaped to have an inclined surface the opening width relative to the inner wall surface of the scroll decreases toward the radial inner side.

4. The structure of a radial turbine scroll according to claim 1, wherein the partition plate is protrusively provided on a turbine casing wall surface continuing to a shroud side of the turbine moving blades of the scroll.

5. The structure of a radial turbine scroll according to claim 1, wherein a flow passage area of the lower space of the partition plate is reduced in the circumferential direction to induce a narrowing effect, thereby generating a gas flow from the lower space to the upper space of the partition plate.

6. The structure of a radial turbine scroll according to claim 1, wherein a flow passage area of the lower space of the partition plate is reduced in the circumferential direction rather than reducing the flow passage area of the upper space of the partition plate, thereby restraining a gas flow from the upper space to the lower space.

7. The structure of a radial turbine scroll according to claim 1, wherein a height between the scroll side walls at the outlet portion of the tongue portion formed on the inner periphery of the gas inlet of the scroll is reduced to decrease a sectional area of the passage at the outlet portion of the tongue portion.

* * * * *